US011174445B2

(12) United States Patent
Feustel et al.

(10) Patent No.: US 11,174,445 B2
(45) Date of Patent: Nov. 16, 2021

(54) ADDITIVES FOR LOW-SULFUR MARINE DIESEL

(71) Applicant: Clariant International Ltd., Muttenz (CH)

(72) Inventors: Michael Feustel, Köngernheim (DE); Matthias Krull, Harxheim (DE); Michael Morscher, Frankfurt (DE)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 15/501,381

(22) PCT Filed: Jul. 13, 2015

(86) PCT No.: PCT/EP2015/065932
§ 371 (c)(1),
(2) Date: Feb. 2, 2017

(87) PCT Pub. No.: WO2016/020144
PCT Pub. Date: Feb. 11, 2016

(65) Prior Publication Data

US 2017/0233670 A1 Aug. 17, 2017

(30) Foreign Application Priority Data

Aug. 7, 2014 (DE) ..... 102014011698.0

(51) Int. Cl.

| | |
|---|---|
| ***C10L 10/16*** | (2006.01) |
| ***C10L 1/14*** | (2006.01) |
| ***C10L 1/10*** | (2006.01) |
| *C10L 1/16* | (2006.01) |
| *C10L 1/196* | (2006.01) |
| *C10L 1/197* | (2006.01) |
| *C10L 1/195* | (2006.01) |

(52) U.S. Cl.
CPC ..... *C10L 10/16* (2013.01); *C10L 1/10* (2013.01); *C10L 1/146* (2013.01); *C10L 1/1641* (2013.01); *C10L 1/1955* (2013.01); *C10L 1/1963* (2013.01); *C10L 1/1966* (2013.01); *C10L 1/1973* (2013.01); *C10L 2200/0438* (2013.01); *C10L 2230/14* (2013.01); *C10L 2250/04* (2013.01); *C10L 2270/026* (2013.01)

(58) Field of Classification Search
CPC .... C10L 2270/026; C10L 10/16; C10L 10/10; C10L 1/146
See application file for complete search history.

(56) References Cited

U.S. PATENT DOCUMENTS

| | | | | |
|---|---|---|---|---|
| 3,726,653 | A | 4/1973 | Van Der Meij | |
| 5,441,545 | A | 8/1995 | Lewtas | |
| 8,338,344 | B2 * | 12/2012 | Maehling | C08F 210/02 44/388 |
| 9,109,176 | B2 * | 8/2015 | Stern | C10G 45/02 |
| 2002/0028890 | A1 | 3/2002 | Krull | |
| 2005/0126071 | A1 | 6/2005 | Krull | |
| 2006/0126072 | A1 | 6/2006 | Olson | |
| 2008/0016754 | A1 | 1/2008 | Siggelkow | |
| 2012/0246999 | A1 | 10/2012 | Stern | |

FOREIGN PATENT DOCUMENTS

| | | | | |
|---|---|---|---|---|
| CA | 932093 | | 8/1973 | |
| CA | 2106185 | | 2/1995 | |
| CA | 2296229 | | 7/2000 | |
| DE | 2022588 | | 11/1970 | |
| DE | 144066 | | 9/1980 | |
| EP | 0155807 | | 9/1985 | |
| EP | 0156577 | | 10/1985 | |
| EP | 0271738 | | 6/1988 | |
| EP | 0922716 | | 6/1999 | |
| EP | 1022293 | | 7/2000 | |
| EP | 1881053 | A2 * | 1/2008 | C10L 10/14 |
| WO | 9116407 | | 10/1991 | |

OTHER PUBLICATIONS

Machine Translation of EP 1881053.*
Machine translation of EP1881053 (Year: 2008).*
Machine Translation of EP1881053 (Year: 2007).*
https://web.archive.org/web/20170209210448/https://www.vitol.com/what-we-do/trading/middle-distillates/ (Year: 2017).*
https://www.marquard-bahls.com/en/news-info/glossary/detail/term/middle-distillates-gasoil.html (Year: 2015).*
Machine Translation of EP-1881053-A2 (Year: 2008).*
Reders, K., et al., "Marine Fuels", Ullmann's Encyclopedia of Industrial Chemistry, vol. 22, pp. 265-270, 2012.
International Search Report for PCT/EP2015/065932, dated Oct. 19, 2015, 3 pages.
English Abstract for DD144066, Sep. 24, 1980, 1 page.

* cited by examiner

*Primary Examiner* — Ellen M McAvoy
*Assistant Examiner* — Ming Cheung Po
(74) *Attorney, Agent, or Firm* — Tod A. Waldrop

(57) ABSTRACT

This invention relates to a fuel oil composition, containing a low-sulfur marine diesel having a sulfur content of less than 1 wt. % and (A) at least one ethylene copolymer and (B) at least one comb polymer.

28 Claims, No Drawings

ADDITIVES FOR LOW-SULFUR MARINE DIESEL

The present invention relates to low-sulfur marine diesel having improved cold properties and storage stability.

For the propulsion of ships and especially of ocean-going ships, the use of heavy oils is customary. Fuels of this kind are also referred to as marine diesel oil (marine fuel oil), marine residue oil (residual fuel oil) or bunker oil (bunker fuel, bunker C). These very inexpensive fuels are based on residues from mineral oil distillation, which are blended with greater or lesser amounts of less viscous distillates ("cutter stocks") in order to adjust various physicochemical parameters, for example density, viscosity, flashpoint and/or sulfur content. The residue oils used to produce such marine fuels contain predominantly relatively heavy molecules: long-chain alkanes and alkenes, cycloalkanes of relatively high molecular weight, and highly fused aromatic hydrocarbons (asphaltenes), and also metal compounds, for example of nickel, vanadium, sodium and calcium. There are additionally various nitrogen and sulfur compounds. The sulfur content of such residue oils is often up to 6% by weight, and so blending with lower-sulfur components is required even to attain the specified upper limit of, for example, 3.5% in bunker oil C. But even higher-value marine fuels based predominantly or entirely on mineral oil distillates typically contain up to 3.5% by weight and in some cases up to 4.5% by weight of sulfur. The nitrogen content of residue oils is often 0.5% by weight or more.

On combustion, the abovementioned impurities lead to various unwanted effects, for example corrosion of equipment, formation of ash and fine dust, and toxic emissions. The high sulfur content of the heavy oil leads to high sulfur dioxide emissions; nitrogen-containing compounds lead to $NO_x$ emissions. Specifically in the case of ships (for example in the case of oil tankers, in the case of other transport ships, cruise ships), there is generally no desulfurization of the exhaust gases, and so the result is high levels of environmental pollution.

The high content of long-chain paraffins and asphaltenes in heavy oils imparts very high viscosities (about 1500 to 10 000 $mm^2/s$ at 20° C. according to the type) to these oils. The specification of the intermediate fuel oil (IFO) used in many ships limits the viscosity to a maximum of 380 $mm^2/s$ at 50° C. The pour point (determinable according to ISO 3016), which is of relevance for the ease of use of the oils, is specified at a maximum of 30° C. for most heavy oil types. In order to make them pumpable, however, the heavy oils have to be heated to temperatures well above the pour point, i.e. to 40 to about 50° C., and also kept at this temperature during transport, for example by means of heated conduits. Heavy oils are often stored at these high temperatures as well, particularly on board ships. This requires energy, the generation of which leads to additional environmental pollution as well as corresponding costs.

To lower the pour point, what are called pour point depressants are often added to heavy oils. These are additives that modify the crystal structure of the paraffins which precipitate out at low temperatures, and shift the solidification of the oil to lower temperatures.

DD 144066 discloses addition of 0.01% to 0.5% of a copolymer of ethylene and vinyl acetate to marine diesel oil in order to improve pumpability, the copolymer having a molecular weight spectrum between 500 and 40 000 and the vinyl acetate content being 20%-50%.

The prior art further discloses what are called comb polymers, which derive from ethylenically unsaturated monomers having relatively long (e.g. $C_8$-$C_{30}$), preferably linear, alkyl radicals. Particularly in crude oils, heating oils that contain residues, and relatively high-boiling, paraffin-rich mineral oil distillates, these are also used in combination with ethylene copolymers to improve the cold flow properties. This lowers the pour point and, in the case of mineral oil distillates, also the cold filterability (CFPP value, determinable according to EN 116) of the oil.

U.S. Pat. No. 3,726,653 discloses the use of ethylene copolymers together with oil-soluble polymers bearing aliphatic alkyl chains having at least 14 carbon atoms as pour point depressants for crude oils and residue oils. A comb polymer demonstrated by way of example is poly(eicosyl acrylate).

DE-A-2022588 discloses flow improvers for use in residue fuels, heating oils and crude oils, containing a polymer having a multitude of essentially linear paraffinic side chains each having at least 18 carbon atoms and an ethylene copolymer with at least one further ethylenically unsaturated compound. These additives are especially suitable for treatment of heating oils that contain residues, and for treatment of flash distillates (distillate heating oils).

CA 2106185 discloses a method of lowering the viscosity of residue oils, in which a mixture of an ethylene-vinyl acetate copolymer and a dialkyl fumarate-vinyl acetate copolymer is added to the residue oil.

EP-A-1022293 discloses terpolymers of esters of ethylenically unsaturated dicarboxylic acids, α-olefins and ethylenically unsaturated polyolefins having 50 to 350 carbon atoms, and the joint use thereof for improving the cold flow properties of crude oils, distillate oils or fuel oils and lubricant oils. These can also be used together with paraffin dispersants.

In order to reduce air pollution by ships, the International Maritime Organization (IMO) supplemented the International Convention for the Prevention of Pollution from Ships (MARPOL) with an annex VI, which, since coming into force in 2005, has limited the sulfur content of marine fuels among other parameters. Starting from an initial limit of max. 4.5% by weight and, since 2012, max. 3.5% by weight of sulfur, further stepwise lowering to max. 0.5% by weight is planned for 2020. In selected areas, called the SECAs ($SO_x$ Emission Control Areas), for example the Baltic Sea, the North Sea including the English Channel and in the region of the North American coastline, the sulfur content of the fuels has been limited from initially 1.5% by weight since 2010 to 1.0% by weight, and a further lowering to 0.10% by weight is stipulated from 2015. In European harbors, it has already long been the case that only the use of fuels with max. 0.1% by weight is permissible. Corresponding qualities are specified, for example, in ISO/DFIS 8217:2010.

The drastic lowering of the sulfur content needed for the production of these marine fuels that will be required in the future is making it virtually impossible to use conventional mineral oil distillation residues, for example vacuum distillation residues, and is requiring far-reaching modifications to the production processes in refineries. One way of producing low-sulfur marine diesels is, for example, the use of distillate fractions and preferably of heavy distillate fractions which have been subjected to desulfurization, for example a hydrogenating desulfurization. Further ways of producing low-sulfur marine diesel which are of significantly greater commercial interest are the use of residues from refinery processes where the feed product has been subjected to desulfurization before being supplied to said refinery process, and especially the use of residues from refinery processes in the course of which desulfurization and specifically hydrogenating desulfurization is effected. Suitable inexpensive base components for production of low-sulfur marine diesel are, for example, residues from a cracking plant operated with heavy gas oil, for example the vacuum gas oil that originates from a vacuum distillation, for example a hydrocracker, an FCC plant or else an isocracker. Oils of this kind are often referred to as "unconverted oil" (UCO) in the refinery. In order to adjust low-sulfur process residues of this kind with respect to density, viscosity and other features so as to meet specifications, they are usually diluted with distillates of low viscosity, called cutter stocks, for example diesel, kerosene or vacuum gas oil. Such a dilution is often indeed required in order to improve the response characteristics to cold additives.

In desulfurization processes, and especially in the hydrogenating desulfurization typically employed, not only are sulfur compounds also nitrogen compounds removed from the oil, but unsaturated compounds such as olefins and aromatics are also at least partly hydrogenated. As a result, there is typically a significant rise in the content of paraffinic constituents having often high molecular weight in the oil, which leads to paraffin deposits often even at temperatures above 20° C., frequently above 30° C. and in some cases at 40° C. or higher ("wax appearance temperature", "WAT" and/or cloud point). A few degrees below the commencement of paraffin crystallization, the pour point of the oil is already attained and the oil loses flowability. It is not generally possible by dilution with cutter stocks to lower the deposition of paraffin to an extent required for use, and this necessitates the employment of pour point depressants.

As a result of the preparation process therefor, low-sulfur process residues contain barely any asphaltenes, as a result of which their density and their viscosity are very much lower than is the case for conventional heavy oils. In the case of storage of low-sulfur marine diesel below the cloud point, especially after addition of pour point depressants, this leads in many cases to problems that are not observed in the case of conventional heavy oils. Particularly at storage temperatures below the cloud point but still above the pour point, because of the low viscosity of the oil, sedimentation of the precipitated paraffins of higher specific density is frequently observed after only a few days and in some cases even after a few hours. This leads to a paraffin-rich layer at the base of the storage vessel which is comparatively difficult to pump and makes it virtually impossible to empty the vessel of residues without prior heating. In addition, low-sulfur marine diesel, before being supplied to the combustion chamber, is typically filtered. While impurities from the conventional residue oils of significantly higher viscosity are typically removed by means of separators, for example cyclones, this removal from low-sulfur marine diesel is effected by means of felt or paper filters having a pore size of often less than 100 μm and in some cases even less than 10 μm. In the case of use of low-sulfur marine diesel at temperatures below the cloud point, this can lead to blockage of the fuel filters by the paraffins that have then precipitated out and hence to failure of the engine.

Because of the changes mentioned, the composition and properties of low-sulfur marine diesel differ significantly from conventional heavy oils. Low-sulfur marine diesel is supposed to be clear and light-colored; according to ISO 8217, the pour point is now limited to a maximum of +6° C. and in winter to a maximum of −6° C. in some cases. According to ISO 8217, its viscosity is limited to a maximum of 11 $mm^2/s$ at 40° C. and in specific qualities even to 1.4 to 5.5 $mm^2/s$ at 40° C. On the other hand, the heavy components used for the production thereof and especially the residues that originate from refinery processes contain large amounts of long-chain paraffins.

For the dispersion of paraffins in middle distillates, typically nitrogen compounds, especially amide-ammonium salts formed from polycarboxylic acids and fatty amines, are used. In low-sulfur marine diesel, these do not exhibit satisfactory efficacy or require very high dosage rates.

It was thus an object of the invention to provide low-sulfur marine diesel having a minimum pour point (determined according to ISO 3016). At the same time, they are to exhibit only low or ideally no sedimentation of paraffins on storage below the cloud point. Their filterability below the cloud point is to be very substantially uniform through the entire volume; it is to be impaired only insignificantly, if at all, with respect to filterability above the cloud point. The additives to be used for the purpose are to be free of sulfur compounds and nitrogen compounds, in order not to increase the content of environmentally harmful components in the oil.

It has been found that, surprisingly, by combination of flow improvers based on ethylene copolymers with particular comb polymers, it is possible both to lower the pour point of low-sulfur marine diesel and simultaneously to reduce or suppress the sedimentation of paraffins that precipitate out under cold conditions. In this way, ease of use and filterability of the fuels thus additized and the reliable operation of the machine even after prolonged storage of the fuel at temperatures below the cloud points thereof are assured.

The invention accordingly provides fuel oil compositions comprising a low-sulfur marine diesel having a sulfur content of less than 1% by weight and (A) at least one ethylene copolymer and (B) at least one comb polymer.

The invention further provides for the use of (A) at least one ethylene copolymer and (B) at least one comb polymer for dispersion of the paraffins that precipitate out of low-sulfur marine diesel having a sulfur content of less than 1% by weight on storage below the cloud point.

The invention further provides for use of at least one comb polymer (B) for dispersion of the paraffins that precipitate out of a low-sulfur marine diesel comprising at least one ethylene copolymer (A) and having a sulfur content of less than 1% by weight on storage below the cloud point.

The present invention further provides a method of dispersing paraffins which precipitate out of low-sulfur marine diesel having a sulfur content of 1% by weight or lower on storage at temperatures below the cloud point, by adding to the low-sulfur marine diesel (A) at least one ethylene copolymer and (B) at least one comb polymer.

The invention further provides a method of dispersing paraffins which precipitate out of a low-sulfur marine diesel having a sulfur content of 1% by weight or lower on storage below the cloud point, wherein the low-sulfur marine diesel contains an ethylene copolymer (A), by adding a comb polymer (B).

Compositions composed of ethylene copolymer (A) and comb polymer (B) are also referred to here as additive.

Suitable ethylene copolymers (A) are especially those which contain 8.0 to 17 mol % of one or more vinyl and/or (meth)acrylic esters and 92.0 to 83 mol % of ethylene. Particular preference is given to ethylene copolymers (A) containing 10.0 to 16.0 mol % of one or more vinyl and/or (meth)acrylic esters and 84.0 to 90.0 mol % of ethylene. Especially preferred are ethylene copolymers having 10.5 to 15.5 mol % of at least one vinyl and/or (meth)acrylic ester and 84.5 to 89.5 mol % of ethylene, and especially 10.5 to 15.0 mol % of at least one vinyl and/or (meth)acrylic ester and 85.0 to 89.5 mol % of ethylene. They may additionally contain minor amounts of further comonomers, for example olefins, in which case the molar content thereof is subtracted from the molar ethylene content.

Vinyl esters suitable as comonomers derive from fatty acids having linear or branched alkyl groups having 1 to 30 carbon atoms and especially having 1 to 18 carbon atoms. Examples include vinyl acetate, vinyl propionate, vinyl butyrate, vinyl hexanoate, vinyl heptanoate, vinyl octanoate, vinyl laurate and vinyl stearate, and also esters of vinyl alcohol based on branched fatty acids, such as vinyl isobutyrate, vinyl pivalate, vinyl 2-ethylhexanoate, vinyl isononanoate, vinyl neononanoate, vinyl neodecanoate and vinyl neoundecanoate.

Suitable ethylene copolymers (A) are both those formed from ethylene and a vinyl ester and those which contain, as well as ethylene, two or more, for example three, four or five, different vinyl esters. Likewise as ethylene copolymers (A) are those which, as well as ethylene, contain one, two or more vinyl esters and one, two or more (meth)acrylic esters (all ethylene copolymers containing two or more copolymers are also referred to here as terpolymers). In addition, suitable ethylene copolymers (A), as a result of their preparation, may contain structural elements derived from initiators and/or moderators in minor amounts.

Preferred ethylene copolymers (A) are copolymers of ethylene and vinyl acetate.

Preferred terpolymers (A) are formed from ethylene, vinyl acetate and vinyl neononanoate or from ethylene, vinyl acetate and vinyl neodecanoate or from ethylene, vinyl acetate and vinyl neoundecanoate or from ethylene, vinyl acetate and vinyl 2-ethylhexanoate. Particularly preferred terpolymers of vinyl neononanoate, of vinyl neodecanoate, of vinyl neoundecanoate and of vinyl 2-ethylhexanoate contain, apart from ethylene, 7.7 to 15.9 mol %, particularly 9.5 to 15.4 mol % and especially 10.0 to 15.0 mol %, for example 10.5 to 15.0 mol % of vinyl acetate and 0.1 to 6 mol %, particularly 0.2 to 5 mol % and especially 0.3 to 5 mol % of the respective long-chain vinyl ester, where the total comonomer content is between 8.0 and 16.0 mol %, particularly between 10.0 and 15.5 mol % and especially between 10.5 and 15.0 mol %, for example between 10.5 and 14.5 mol %.

(Meth)acrylic esters suitable as comonomers are esters of acrylic acid and methacrylic acid and preferably those having 1 to 20 carbon atoms in the alkyl radical, such as methyl (meth)acrylate, ethyl (meth)acrylate, n- and isopropyl (meth)acrylate, n- and isobutyl (meth)acrylate, hexyl, octyl, 2-ethylhexyl, decyl, dodecyl, tetradecyl, hexadecyl, octadecyl (meth)acrylate. Also suitable are mixtures of two, three, four or else more of these comonomers. In a preferred embodiment, terpolymers of ethylene, a vinyl ester and a (meth)acrylic ester, for example terpolymers of ethylene, vinyl acetate and methyl acrylate, of ethylene, vinyl acetate and isobutyl acrylate or of ethylene, vinyl acetate and 2-ethylhexyl acrylate, are used. Particularly preferred terpolymers contain, apart from ethylene, 7.7 to 16.9 mol %, particularly 9.5 to 15.9 mol % and especially 10.0 to 15.4 mol %, for example 10.5 to 14.9 mol % of vinyl acetate and 0.1 to 6 mol %, particularly 0.2 to 5 mol % and especially 0.3 to 5 mol % of the particular (meth)acrylic ester, where the total comonomer content is between 8.0 and 17.0 mol %, particularly between 10.0 and 16.0 mol % and especially between 10.5 and 15.5 mol %, for example between 10.5 and 15.0 mol %.

Further preferred copolymers (A) contain, as well as ethylene and 8.0 to 17 mol %, more preferably 10 to 16.0 mol % and especially 10.5 to 15.5, for example 10.5 to 15.0 mol %, of one or more vinyl and/or (meth)acrylic esters, also 0.1 to 5 mol % and preferably 0.2 to 4 mol % of one or more olefins having 3 to 8 carbon atoms, for example propene, butene, isobutylene, hexene, 4-methylpentene, octene, diisobutylene and/or norbornene, in which case the molar content thereof is subtracted from the molar ethylene content. A preferred olefin is propene. Particularly preferred terpolymers of ethylene, one or more vinyl and/or (meth) acrylic esters and propene have 0.5 to 4.0 methyl groups derived from propene per 100 aliphatic carbon atoms. The number of methyl groups derived from propene (propene $CH_3$) per 100 aliphatic carbon atoms is determined by means of $^{13}C$ NMR spectroscopy. For instance, terpolymers of ethylene, vinyl esters and propene exhibit a characteristic signal of methyl groups bonded to the polymer backbone between about 19.3 and 19.9 ppm, which have a positive sign in the DEPT experiment. The integral of this signal of the methyl side groups of the polymer backbone that are derived from propene is expressed as a ratio to that of all the other aliphatic carbon atoms in the polymer backbone between about 6 and 44 ppm. Signals that arise from the alkyl radicals of the unsaturated esters and overlap with signals of the polymer backbone are subtracted from the total integral of the aliphatic carbon atoms on the basis of the signal of the methine group adjacent to the carbonyl group of the unsaturated ester. Such measurements can be conducted, for example, with NMR spectrometers at a measurement frequency of 125 MHz at 30° C. in solvents such as $CDCl_3$ or $C_2D_2Cl_4$. Particular preference is given to terpolymers of ethylene, vinyl acetate and propene, of ethylene, vinyl neononanoate and propene, of ethylene, vinyl neodecanoate and propene, and of ethylene, vinyl 2-ethylhexanoate and propene.

The copolymers (A) preferably have number-average molecular weights Mn between 1000 and 7000 g/mol and especially between 1200 and 5000 g/mol. The weight-average molecular weight is preferably between 2000 and 20 000 g/mol, more preferably between 3000 and 15 000 g/mol and especially between 3500 and 12 000 g/mol, in each case determined by means of gel permeation chromatography (GPC) in THF against poly(styrene) standards. The molecular weight of the copolymers (A) can also be characterized via their melt viscosity; the melt viscosity of preferred copolymers (A) measured at 140° C. (without solvent) is between 20 and 5000 mPas, particularly between 30 and 2000 mPas and especially between 50 and 1500 mPas. The degrees of branching of the copolymers (A) determined by means of $^1H$ NMR spectroscopy are preferably between 2 and 7 $CH_3$/100 $CH_2$ groups, especially between 2.5 and 6 $CH_3$/100 $CH_2$ groups, for example 2.7 to 5 $CH_3$/100 $CH_2$ groups, which do not originate from the comonomers.

The copolymers (A) are preparable by known copolymerization processes, for example suspension polymerization, solvent polymerization or high-pressure bulk polymerization. Preferably, the copolymers (A) are prepared by means of high-pressure bulk polymerization at pressures of 50 to 400 MPa, preferably 100 to 300 MPa, and temperatures of 100 to 300° C., preferably 150 to 220° C. In a particularly preferred preparation variant, the polymerization is effected in a multizone reactor, with the temperature differential between the peroxide feeds along the tubular reactor kept to a minimum, i.e. <50° C., preferably <30° C., especially <15° C. Preferably, the temperature maxima in the individual reaction zones differ by less than 30° C., more preferably by less than 20° C. and especially by less than 10° C.

The reaction of the monomers is initiated by initiators that form free radicals (free-radical chain initiators). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxydicarbonate, t-butyl perpivalate, t-butyl permaleate, t-butyl perbenzoate, dicumyl peroxide, t-butyl cumyl peroxide, di(t-butyl) peroxide, 2,2'-azobis(2-methyl-propanonitrile), 2,2'-azobis(2-methylbutyronitrile). The initiators are used individually or as a mixture of two or more substances in amounts of 0.01% to 20% by weight, preferably 0.05 to 10% by weight, based on the monomer mixture.

The high-pressure bulk polymerization is conducted in known high-pressure reactors, for example autoclaves or tubular reactors, in a batchwise or continuous manner; particularly useful reactors have been found to be tubular reactors. Solvents such as aliphatic and/or aromatic hydrocarbons or hydrocarbon mixtures, benzene or toluene may be present in the reaction mixture. Preference is given to the essentially solvent-free mode of operation. In a preferred embodiment of the polymerization, the mixture of the monomers, the initiator and, if used, the moderator is fed to a tubular reactor through the reactor inlet and via one or more side branches. Preferred moderators are, for example, hydrogen, saturated and unsaturated hydrocarbons, for example propane or propene, aldehydes, for example propionaldehyde, n-butyraldehyde or isobutyraldehyde, ketones, for example acetone, methyl ethyl ketone, methyl isobutyl ketone, cyclohexanone, and alcohols, for example butanol, and mixtures thereof. In the case of use of moderators, the copolymers (A) may contain, at the chain ends, structural elements derived from the respective moderators. The comonomers, and also the moderators, can be metered into the reactor either together with ethylene or separately via sidestreams. At the same time, the monomer streams may be of different composition (EP-A-0 271 738 and EP-A-0 922 716).

In a preferred embodiment, mixtures of identical or different copolymers (A) are used, in which case the copolymers underlying the mixtures differ in at least one characteristic. For example, they may contain different comonomers or have different comonomer contents, molecular weights and/or different degrees of branching. For instance, mixtures of copolymers (A) wherein the comonomer content differs by at least 2 mol % have been found to be particularly useful. The mixing ratio of the various ethylene copolymers (A) is preferably between 20:1 and 1:20, preferably 10:1 to 1:10, especially 5:1 to 1:5, for example between 20:1 and 1:10, between 20:1 and 1:5, between 1:20 and 10:1 or between 1:20 and 5:1.

Preferred comb polymers (B) contain at least 40 mol %, preferably 50 to 100 mol %, more preferably 60 to 95 mol % and especially 65 to 90 mol % of repeat structural units (B1) bearing $C_{10}$-$C_{28}$-alkyl radicals. Thus, the proportion of repeat structural units (B1) in the comb polymers (B) may, for example, be between 50 and 100 mol %, between 60 and 100 mol %, between 65 and 100 mol %, between 40 and 90 mol %, between 50 and 90 mol %, between 60 and 90 mol %, between 65 and 90 mol %, between 40 and 95 mol %, between 50 and 95 mol %, between 60 and 95 mol %, or else between 65 and 95 mol %. In a specific embodiment, the comb polymers (B) consist of repeat structural units (B1). These repeat structural units (B1) derive preferably from $C_{10}$-$C_{28}$-alkyl esters of unsaturated mono- and dicarboxylic acids, $C_{10}$-$C_{28}$-alkyl vinyl esters, $C_{10}$-$C_{28}$-alkyl vinyl ethers, $C_{10}$-$C_{28}$-alkyl allyl ethers and/or linear $C_{12}$-$C_{30}$-α-olefins. Particular preference is given to repeat structural units (B1) which bear $C_{12}$-$C_{28}$-alkyl radicals and especially those which bear $C_{14}$-$C_{28}$-alkyl radicals and derive from the correspondingly preferred alkyl esters of unsaturated mono- and dicarboxylic acids, alkyl vinyl esters, alkyl vinyl ethers, alkyl allyl ethers and/or linear α-olefins.

Further preferably, at least 20 mol % of the alkyl radicals bonded to the repeat structural units (B1) have 12 to 16 carbon atoms, and at least 5 mol % have alkyl radicals having 18 or more carbon atoms. More preferably, at least 20 mol % of the alkyl radicals bonded to the repeat structural units (B1) have 14 and/or 16 carbon atoms. In addition, more preferably, at least 5 mol % of the alkyl radicals bonded to the repeat structural units (B1) have with 20 or more carbon atoms.

More preferably, the content of $C_{12}$-$C_{16}$-alkyl radicals in the alkyl radicals bonded to the repeat structural units (B1) is between 25 and 95 mol %, particularly between 30 and 92 mol % and especially between 50 and 90 mol %, and very especially between 60 and 90 mol %, for example between 20 and 95 mol %, between 30 and 95 mol %, between 50 and 95 mol %, between 60 and 95 mol %, between 20 and 92 mol %, between 25 and 92 mol %, between 50 and 92 mol %, between 60 and 92 mol %, between 20 and 90 mol %, between 25 and 90 mol %, between 30 and 90 mol % or else between 60 and 90 mol %. In a specific embodiment, the content of $C_{14}$-$C_{16}$-alkyl radicals in the alkyl radicals bonded to the repeat structural units (B1) is between 25 and 95 mol %, particularly between 30 and 92 mol % and especially between 50 and 90 mol %, and very especially between 60 to 90 mol %, for example between 20 and 95 mol %, between 30 and 95 mol %, between 50 and 95 mol %, between 60 and 95 mol %, between 20 and 92 mol %, between 25 and 92 mol %, between 50 and 92 mol %, between 60 and 92 mol %, between 20 and 90 mol %, between 25 and 90 mol %, between 30 and 90 mol % or else between 60 and 90 mol %.

More preferably, the content of alkyl radicals having 18 or more carbon atoms in the alkyl radicals bonded to the repeat structural units (B1) is between 5 and 75 mol %, particularly between 8 and 70 mol % and especially between 10 and 50 mol %, and very especially between 10 and 40 mol %, for example between 5 and 80 mol %, between 5 and 70 mol %, between 5 and 50 mol %, between 5 and 40 mol %, between 8 and 80 mol %, between 8 and 75 mol %, between 8 and 50 mol %, between 8 and 40 mol %, between 10 and 80 mol %, between 10 and 75 mol %, between 10 and 70 mol % or else between 10 and 40 mol %. In a further particularly preferred embodiment, the content of alkyl radicals having 20 or more carbon atoms in the alkyl radicals bonded to the repeat structural units (B1) is between 5 and 75 mol %, particularly between 8 and 70 mol % and especially between 10 and 50 mol %, and very especially between 10 and 40 mol %, for example between 5 and 80 mol %, between 5 and 70 mol %, between 5 and 50 mol %, between 5 and 40 mol %, between 8 and 80 mol %, between 8 and 75 mol %, between 8 and 50 mol %, between 8 and 40 mol %, between 10 and 80 mol %, between 10 and 75 mol %, between 10 and 70 mol % or else between 10 and 40 mol %.

In a preferred embodiment, the proportions of the alkyl radicals bonded to the repeat structural units (B1) and having 12 to 16 carbon atoms together with the proportions of the alkyl radicals bonded to the repeat structural units (B1) and having 18 or more carbon atoms add up to 100%. In a further preferred embodiment, the proportions of the alkyl radicals bonded to the repeat structural units (B1) and having 14 and/or 16 carbon atoms together with the proportions of the alkyl radicals bonded to the repeat structural units (B1) and having 18 or more carbon atoms add up to 100%. In a further preferred embodiment, the proportions of the alkyl radicals bonded to the repeat structural units (B1) and having 12 to 16 carbon atoms together with the proportions of the alkyl radicals bonded to the repeat structural units (B1) and having 20 or more carbon atoms add up to 100%.

In a further preferred embodiment, the proportions of the alkyl radicals bonded to the repeat structural units (B1) and having 14 and/or 16 carbon atoms together with the proportions of the alkyl radicals bonded to the repeat structural units (B1) and having 20 or more carbon atoms add up to 100%.

In a further preferred embodiment, the sum S $$S = \frac{\left( m_1 \cdot p_1 \cdot \sum_i w_{1i} \cdot n_{1i} + m_2 \cdot p_2 \cdot \sum_j w_{2j} \cdot n_{2j} + \ldots + m_g \cdot p_g \sum_p w_{gp} \cdot n_{gp} \right)}{(m_1 \cdot p_1 + m_2 \cdot p_2 + \ldots + m_g \cdot p_g)}$$

of the molar averages of the carbon chain length distributions in the alkyl radicals of the repeat structural units (B1) is 15.0 to 20.0, in which $m_1, m_2, \ldots m_g$ are the mole fractions of the abovementioned monomers in the polymer (B), where the sum of the mole fractions $m_1$ to $m_g=1$, $p_1; p_2; \ldots p_g$ is the number of alkyl radicals per monomer unit and is an integer of 1, 2 or 3, $w_{1i}, w_{1j} \ldots w_{2i}, w_{2j} \ldots w_{gp}$ are the proportions by weight of the individual chain lengths i, p of the alkyl radicals of the various monomers (B) 1 to g in the polymer, and $n_{1i}, n_{1j} \ldots n_{2i}, n_{2j} \ldots n_{gp}$ are the chain lengths of the alkyl radicals i, p of the monomers in the polymer (B) 1 to g.

In a preferred embodiment of the invention, S assumes values between 15.1 and 19.5, particularly between 15.3 and 18.9 and especially between 15.5 and 18.5, for example between 15.0 and 19.5, between 15.0 and 18.9, between 15.0 and 18.5, between 15.1 and 18.0, between 15.1 and 18.9, between 15.1 and 18.5, between 15.3 and 19.5, between 15.3 and 18.5, between 15.5 and 20.0, between 15.5 and 19.5 or else between 15.5 and 18.9.

For monomers which bear one alkyl radical per monomer unit, for example alkyl (meth)acrylates, monoesters of dicarboxylic acids, alkyl vinyl esters and alkyl vinyl ethers, p is 1; for monomers which bear two alkyl radicals, for example diesters of ethylenically unsaturated dicarboxylic acids, for example maleic acid or fumaric acid, p is 2.

Particularly effective additives are those composed of (A) and (B), wherein the alkyl chain distribution contains both the abovementioned proportions of $C_{12}$- to $C_{16}$- and preferably of $C_{14}$- and/or $C_{16}$-alkyl radicals and the abovementioned proportions of alkyl radicals having 18 or more carbon atoms and preferably having 20 or more carbon atoms, and wherein the molar average of the carbon chain length distribution in the alkyl radicals of the repeat structural units (B1) falls within the above-defined range for the sum S.

The alkyl radicals of the structural units B1 are preferably linear, but may also contain minor amounts of branched isomers of up to 30 mol %, preferably up to 20 mol % and especially 2 to 5 mol %.

In a preferred embodiment, the distribution of the alkyl chain lengths of the repeat units (B1) which is preferred in accordance with the invention is implemented in one polymer. In a further preferred embodiment, the inventive distribution of the alkyl chain lengths is achieved by mixing two or more polymers, for example three, four or more polymers. For instance, the mixing of a polymer (B") having a relatively high proportion of $C_{14}/C_{16}$ side chains with a polymer (B") having a relatively high proportion of side chains having more than 18 carbon atoms leads to additives that are suitable in accordance with the invention, provided that the side chain distribution and/or the sum S is within the preferred range.

In a further preferred embodiment, the comb polymer (B) contains up to 60 mol %, preferably 1 to 50 mol %, particularly 10 to 40 mol % and especially 20 to 40 mol %, for example 1 to 60 mol %, 1 to 40 mol %, 10 to 60 mol %, 10 to 50 mol %, 20 to 60 mol % or else 20 to 50 mol %, of further repeat structural units (B2). Preferred further repeat structural units (B2) derive from unsaturated mono- and dicarboxylic acids and their $C_1$- to $C_9$-alkyl esters, $C_1$-$C_9$-alkyl vinyl esters, $C_1$-$C_9$-alkyl vinyl ethers, $C_1$-$C_9$-alkyl allyl ethers, linear $C_3$-$C_8$-α-olefins and/or branched $C_4$-$C_{50}$-olefins. The repeat structural units (B2) may also bear heteroatoms such as oxygen, nitrogen and/or sulfur. Examples of suitable further comonomers from which repeat structural units (B2) derive are vinyl acetate, methyl acrylate, methyl methacrylate, ethyl acrylate, ethyl methacrylate, hydroxyethyl methacrylate, hydroxypropyl methacrylate, hexene, styrene, and also branched olefins such as, more particularly, oligomers of isobutylene and propylene having 10 to 20 carbon atoms.

More preferably, the polymers B) consist solely of the repeat structural units B1) and optionally B2), which in that case add up to 100 mol %.

Preferred monomers from which the repeat structural units (B1) of the copolymers (B) derive are esters of unsaturated carboxylic acids having 3 to 8 carbon atoms and especially having 3 to 6 carbon atoms, for example of acrylic acid, methacrylic acid, maleic acid, fumaric acid and itaconic acid, with alcohols that bear alkyl radicals having 10 to 28 carbon atoms. Preferred alcohols are linear, but they may also contain minor amounts, for example up to 20% by weight, preferably up to 10% by weight and especially up to 5% by weight of branched alkyl radicals. If present, the branches are preferably in the 1 or 2 position. Examples of preferred alcohols are decanol, undecanol, dodecanol, n-tridecanol, isotridecanol, tetradecanol, pentadecanol, hexadecanol, octadecanol, eicosanol, docosanol, tetracosanol, hexacosanol, octacosanol and mixtures thereof. Dicarboxylic acids can be used in the form of partial esters; however, preference is given to using the diesters thereof. Diesters are understood to mean those compounds in which at least 70 mol %, particularly 70 to 98 mol % and especially 80 to 95 mol %, for example 70 to 100 mol %, 70 to 95 mol %, 80 to 100 mol % or else 80 to 98 mol %, of the carboxyl groups are in esterified form.

Further preferred monomers from which the repeat structural units (B1) of the copolymers (B) derive are esters and/or ethers formed from ethylenically unsaturated alcohols having 2 to 10 and especially having 2 to 4 carbon atoms and carboxylic acids or alcohols which bear alkyl radicals having 10 to 28 carbon atoms. Examples of such monomers are esters of vinyl alcohol with decanoic acid, neodecanoic acid, undecanoic acid, neoundecanoic acid, dodecanoic acid, tridecanoic acid, tetradecanoic acid, pentadecanoic acid, hexadecanoic acid, octadecanoic acid, eicosanoic acid, docosanoic acid, tetracosanoic acid, hexacosanoic acid, octacosanoic acid and mixtures thereof. Further examples of such monomers are ethers of allyl alcohol and especially of vinyl alcohol with decanol, undecanol, dodecanol, n-tridecanol, isotridecanol, tetradecanol, pentadecanol, hexadecanol, octadecanol, eicosanol, docosanol, tetracosanol, hexacosanol, octacosanol and mixtures thereof.

Further preferred monomers from which the repeat structural units (B1) of the copolymers (B) derive are olefins having 12 to 30 carbon atoms, preferably having 12 to 24 carbon atoms and especially having 14 to 18 carbon atoms, and mixtures thereof. These are preferably linear α-olefins having a terminal double bond. Side chain length of olefins is understood here to mean the alkyl radical proceeding from the polymer backbone, i.e. the chain length of the monomeric olefin minus the two olefinically bonded carbon atoms. Suitable olefins are, for example, dodecene, tetradecene, hexadecene, octadecene, eicosene, docosene, tetracosene, hexacosene, octacosene and mixtures thereof.

Further monomers such as alkyl (meth)acrylates, alkyl vinyl esters, alkyl vinyl ethers having 1 to 5 carbon atoms in the alkyl radical and ethylenically unsaturated free carboxylic acids, for example acrylic acid, methacrylic acid, maleic acid, fumaric acid, itaconic acid, and also monomers bearing functional groups, for example —OH, —SH, —N—, —CN, and further compounds copolymerizable with the monomers mentioned, for example allyl polyglycol ethers, vinylaromatics and olefins of relatively high molecular weight, such as poly(isobutylene), may likewise be present in the copolymers (B) in minor amounts of up to 20 mol %, preferably up to 10 mol % and especially up to 5 mol %.

All comonomers present in the comb polymer (B) that do not bear $C_{10}$-$C_{28}$-alkyl chains are not taken into account in the calculation of the factor S.

The polymers of the invention can be prepared by direct polymerization from the monomers mentioned in known polymerization methods such as bulk, solution, emulsion, suspension or precipitation polymerization.

Equally, they can be prepared by derivatization of a base polymer bearing acid or hydroxyl groups, for example, with the fatty alcohols or fatty acids described for the preparation of the corresponding esters from unsaturated carboxylic acids or unsaturated alcohols, each having 10 to 28 carbon atoms in the alkyl radical. The esterifications and/or etherifications are effected by known condensation methods. This derivatization may be complete or partial. Partially esterified, acid-based polymers (in solvent-free form) preferably have acid numbers of 60-140 mg KOH/g and especially of 80-120 mg KOH/g. Copolymers having acid numbers of less than 60 mg KOH/g, particularly less than 30 mg KOH/g and especially less than 15 mg KOH/g are considered to be fully derivatized. Partially esterified or etherified polymers bearing hydroxyl groups have OH numbers of 40 to 200 mg KOH/g, preferably 60 to 150 mg KOH/g; copolymers having hydroxyl numbers of less than 40 mg KOH/g, especially less than 25 mg KOH/g and especially less than 20 mg KOH/g are considered to be fully derivatized. Particular preference is given to fully derivatized polymers.

Polymers which bear acid groups and are suitable for the derivatization with fatty alcohols to give esters are homo- and copolymers of ethylenically unsaturated carboxylic acids, for example of acrylic acid, methacrylic acid, maleic acid, fumaric acid, itaconic acid or the reactive equivalents thereof, such as lower esters or anhydrides, for example methyl methacrylate and maleic anhydride, with one another or else with further monomers copolymerizable with these acids. Suitable examples are poly(acrylic acid), poly(methacrylic acid), poly(maleic acid), poly(maleic anhydride), poly(acrylic acid-co-maleic acid) and poly(acrylic acid-co-maleic anhydride).

Polymers which bear hydroxyl groups and are particularly suitable for the derivatization with fatty acids and/or fatty alcohols to give esters and/or ethers are homo- and copolymers of monomers bearing hydroxyl groups, such as vinyl alcohol, allyl alcohol or else hydroxyethyl acrylate, hydroxyethyl methacrylate, hydroxypropyl acrylate and hydroxypropyl methacrylate.

The number-average molecular weights of the copolymers B of the invention are between 1000 and 100 000, particularly between 2000 and 50 000 and especially between 2500 and 25 000 g/mol, measured by means of gel permeation chromatography (GPC) against poly(styrene) standards. Inventive copolymers B must be oil-soluble in practically relevant dosages, meaning that they have to dissolve without residue in the oil to be additized at 50° C.

Examples of suitable comb polymers (B) are

B-i) homo- and copolymers of $C_{10}$-$C_{28}$-alkyl vinyl esters, $C_{10}$-$C_{28}$-alkyl vinyl ethers and unsaturated $C_{10}$-$C_{28}$-alkyl monocarboxylates. Examples of such polymers are poly ($C_{10}$-$C_{28}$-alkyl vinyl esters), poly($C_{10}$-$C_{28}$-alkyl vinyl ethers), poly($C_{10}$-$C_{28}$-alkyl methacrylates), poly($C_{10}$-$C_{28}$-alkyl acrylates), poly($C_{10}$-$C_{28}$-alkyl acrylate-co-$C_{10}$-$C_{28}$-alkyl vinyl esters) and poly($C_{10}$-$C_{28}$-alkyl acrylate-co-$C_{10}$-$C_{28}$-alkyl vinyl ethers). Polymers of this kind are obtainable, for example, by means of free-radical solution, bulk or suspension polymerization.

B-ii) Copolymers, esterified with $C_{10}$-$C_{28}$ alcohols, of unsaturated dicarboxylic acids or anhydrides thereof with $C_{12}$-$C_{30}$-α-olefins, $C_{10}$-$C_{28}$-alkyl acrylates, $C_{10}$-$C_{28}$-alkyl methacrylates, $C_{10}$-$C_{28}$-alkyl vinyl esters and/or $C_{10}$-$C_{28}$-alkyl vinyl ethers. Examples of such polymers are a preferably alternating copolymer, esterified with 1 to 2 mol (based on copolymerized maleic anhydride) of $C_{10}$-$C_{28}$ alcohol, of maleic anhydride and a $C_{12}$-$C_{30}$-α-olefin, a copolymer, esterified with 1 to 2 mol (based on copolymerized maleic anhydride) of $C_{10}$-$C_{28}$ alcohol, of maleic anhydride and a $C_{10}$-$C_{28}$-alkyl acrylate, a copolymer, esterified with 1 to 2 mol (based on copolymerized maleic anhydride) of $C_{10}$-$C_{28}$ alcohol, of maleic anhydride and a $C_{10}$-$C_{28}$-alkyl methacrylate, and a copolymer, esterified with $C_{10}$-$C_{28}$ alcohol, of maleic acid and acrylic acid. Polymers of this kind are obtainable, for example, by means of free-radical solution and bulk polymerization, where the esterification may precede or preferably follow the polymerization of the free acid or its anhydride.

B-iii) $C_{10}$-$C_{28}$-Alkyl fumarate-$C_1$-$C_5$-alkyl vinyl ester copolymers, for example a copolymer of vinyl acetate with a fumaric ester prepared by esterification of fumaric acid with 1 to 2 mol of a $C_{10}$-$C_{30}$ alcohol mixture. Polymers of this kind are obtainable, for example, by means of free-radical solution and bulk polymerization.

B-iv) Polymers of $C_{12}$-$C_{30}$-α-olefins, for example a polymer of hexadecene, octadecene, eicosene, docosene and tetracosene or a polymer of octadecene and docosene, tetracosene and hexacosene. Polymers of this kind are obtainable, for example, via anionic polymerization.

Of the polymers mentioned by way of example, preference is given in turn to those wherein the alkyl chain lengths and/or quantitative contents correspond to the preferred ranges detailed above for the structural units B1 and optionally B2.

In a preferred embodiment, mixtures of the copolymers (B) of the invention are used, with the proviso that the mean of the S values of the mixture components in turn assumes values of 15.0 to 20.0, preferably between 15.1 and 19.5, particularly between 15.3 and 18.9 and especially between 15.5 and 18.5, for example between 15.0 and 19.5, between 15.0 and 18.9, between 15.0 and 18.5, between 15.1 and 18.0, between 15.1 and 18.9, between 15.1 and 18.5, between 15.3 and 19.5, between 15.3 and 18.5, between 15.5 and 20.0, between 15.5 and 19.5 or else between 15.5 and 18.9.

Components (A) and (B) can be added separately to the oils to be additized. They are preferably added as a mixture. The mixing ratio of the additives A and B of the invention is (in parts by weight) 20:1 to 1:20, preferably 10:1 to 1:10, especially 5:1 to 1:3, for example between 20:1 and 1:10, between 20:1 and 1:3, between 10:1 and 1:20, between 10:1 and 1:3, between 10:1 and 1:20, between 10:1 and 1:3, between 5:1 and 1:20 or else between 5:1 and 1:10.

Ethylene copolymers (A) on their own typically have only unsatisfactory efficacy on the cold properties, for example the pour point, of low-sulfur marine diesel. However, the presence thereof leads to marked sedimentation of the paraffins that precipitate out below the cloud point. Comb polymers (B) on their own typically have only slight pour point-lowering and/or paraffin-dispersing efficacy, if any, in low-sulfur marine diesel. The combination of comb polymers (B) with ethylene copolymers (A) achieves synergistic lowering of the pour point and dispersion of the paraffins, such that the additized oil remains pumpable even on prolonged storage below the cloud point and does not lead to filter blockages.

The low-sulfur marine diesels of the invention contain the additives from (A) and (B) preferably in amounts of 0.001% to 2% by weight, preferably 0.005% to 1% by weight and especially 0.01% to 0.5% by weight. They can be used here as such or else in the form of a concentrate dissolved or dispersed in solvents, for example aliphatic and/or aromatic hydrocarbons or hydrocarbon mixtures, for example toluene, xylene, ethylbenzene, decane, pentadecane, gasoline fractions, kerosene, naphtha, diesel, heating oil, isoparaffins or commercial solvent mixtures such as Solvent Naphtha, Shellsol® AB, Solvesso® 150, Solvesso® 200, Exxsol®, Isopar® and Shellsol® D products. The additives of the invention, in the form of concentrate, preferably contain 1% to 90% by weight, especially 10% to 75% by weight and particularly 25% to 60% by weight of solvent.

Low-sulfur marine diesel is understood to mean marine fuels containing a maximum of 1.5% by weight of sulfur, preferably a maximum of 1.0% by weight of sulfur and especially a maximum of 0.5% by weight of sulfur, for example a maximum of 0.1% by weight of sulfur. They preferably have a viscosity of less than 200 $mm^2/s$, more preferably below 100 $mm^2/s$, more preferably between 1.0 and 20 $mm^2/s$, especially preferably between 1.0 and 15 $mm^2/s$, particularly between 1.2 and 15 $mm^2/s$ and especially between 1.4 and 10 $mm^2/s$, for example between 1.0 and 200 $mm^2/s$, between 1.2 and 200 $mm^2/s$, between 1.4 and 200 $mm^2/s$, between 1.0 and 100 $mm^2/s$, between 1.2 and 100 $mm^2/s$, between 1.4 and 100 $mm^2/s$, between 1.0 and 20 $mm^2/s$, between 1.0 and 10 $mm^2/s$, between 1.2 and 20 $mm^2/s$, between 1.2 and 10, between 1.4 and 20 or else between 1.4 and 15 $mm^2/s$, in each case determined according to ISO 3104 at 40° C.

The pour point of particularly suitable low-sulfur marine diesel is in untreated form, i.e. prior to addition of additives that lower the pour point, is at least 6° C., preferably between 6 and 36° C., more preferably between 6 and 33° C., especially between 9 and 33° C., for example between 12 and 30° C. The commencement of paraffin deposition is preferably above 0° C., more preferably above +5° C. and especially above +10° C. The commencement of paraffin deposition can be determined visually by measuring the cloud point (according to ISO 3015) or else by calorimetry, by measuring the heat flow in the course of cooling (by means of differential scanning calorimetry, DSC).

Low-sulfur marine diesels suitable in accordance with the invention can be produced from mineral oil fractions, for example kerosene, light gas oil, heavy gas oil, light and optionally heavy cycle oil, or vacuum gas oil. The additives comprising (A) and (B) or (B), and the methods of treatment of low-sulfur marine diesel containing a residue from the further processing of an optionally previously desulfurized mineral oil distillate that utilize them, have been found to be particularly useful. Suitable residues are obtained in FCC plants in the preparation of olefins from heavy gas oil. Similarly low-sulfur residues are obtained, for example, in hydrocrackers in the processing of vacuum gas oil (VGO) and/or heavy coker gas oil (HCGO) under mild conditions, and in LC fining processes as "unconverted oil" (UCO), and in the cracking of Fischer-Tropsch waxes. Fuel oils suitable for use in marine diesel are also obtainable by desulfurization of residues from mineral oil distillation.

Residues used with preference for the production of marine diesels suitable in accordance with the invention have a final boiling point above 450° C., more preferably above 480° C., particularly above 500° C. and especially above 510° C. (determinable according to ASTM D-2887). Further preferred residues have a 50% distillation point above 400° C., more preferably above 420° C., particularly above 435° C. and especially above 450° C. (likewise determinable according to ASTM D-2887).

Preferred residues typically contain more than 3% by weight and preferably 3% to 40% by weight, more preferably 4% to 30% by weight, particularly 5% to 25% by weight and especially 6% to 20% by weight, for example 3% to 30% by weight, 3% to 25% by weight, 3% to 20% by weight, 4% to 40% by weight, 4% to 25% by weight, 4% to 20% by weight, 5% to 40% by weight, 5% to 30% by weight, 5% to 20% by weight, 6% to 40% by weight, 6% to 30% by weight or else 6% to 25% by weight of paraffins having carbon chain lengths of more than 24 carbon atoms. For the determination of carbon chain distribution and content of the n-paraffins in the low-sulfur residue, gas chromatography (GC) and, in the case of particularly high-boiling residues, high-temperature GC have been found to be useful. With the latter method, it is possible to analyze paraffins having 80 or more carbon atoms. In such particularly high-boiling residues, the above-specified paraffin contents relate to paraffins having 25 to 80 carbon atoms.

The sulfur content of the residues preferred for the production of marine diesels suitable in accordance with the invention is preferably below 0.5% by weight, preferably between 1 and 3000 ppm by weight, more preferably between 5 and 2000 ppm by weight, particularly between 10 and 1500% by weight and especially between 20 and 1000 ppm by weight, for example between 1 and 5000 ppm by weight, between 1 and 2000 ppm by weight, between 1 and 1500 ppm by weight, between 1 and 1000 ppm by weight, between 5 and 5000 ppm by weight, between 5 and 3000 ppm by weight, between 5 and 1500 ppm by weight, between 10 and 5000 ppm by weight, between 10 and 3000 ppm by weight, between 10 and 2000 ppm by weight or else between 10 and 2500 ppm by weight.

The viscosity, measured at 40° C., of residues preferred for the production of marine diesels suitable in accordance with the invention is typically between 10 and 1000 $mm^2/s$, particularly between 15 and 500 $mm^2/s$ and especially between 20 and 100 $mm^2/s$, for example between 10 and 500 $mm^2/s$, between 10 and 100 $mm^2/s$, between 15 and 1000 $mm^2/s$, between 20 and 500 $mm^2/s$ or else between 20 and 500 $mm^2/s$.

The pour point of residues preferred for the production of marine diesels suitable in accordance with the invention is typically 9° C. or higher, often 12 to 60° C. and especially 15 to 51° C., for example 9 to 60° C., 15 to 60° C., 9 to 51° C. or else 15 to 51° C. Preferably, they contain only small amounts of asphaltenes, if any, for example less than 2% by weight and especially less than 1% by weight.

The proportion of process residues in the low-sulfur marine diesel is preferably 5% to 90% by weight, more preferably 10% to 80% by weight, particularly 15% to 75% by weight and especially 20% to 70% by weight, for example 5% to 80% by weight, 5% to 75% by weight, 5% to 70% by weight, 10% to 90% by weight, 10% to 75% by weight, 10% to 70% by weight, 35% to 90% by weight, 15% to 90% by weight, 15% to 80% by weight, 15% to 70% by weight, 20% to 90% by weight, 20% to 80% by weight or else 20% to 75% by weight. Preferably, low-sulfur marine diesels suitable in accordance with the invention contain less than 10% by weight of a residue from crude oil distillation, more preferably 0.1% to 3% by weight, and they are especially free of residues from crude oil distillation.

Accordingly, the total content of metals in low-sulfur marine diesels that are particularly suitable in accordance with the invention (determinable, for example, by ICP) is below 500 ppm (m/m), preferably below 200 ppm (m/m) and especially below 100 ppm (m/m), for example below 50 ppm (m/m).

For establishment of the parameters specified for the particular use and for the purpose of easier handling, residues of this kind are preferably mixed with lighter components ("cutter stocks"), for example kerosene, light gas oil, heavy gas oil, light and optionally heavy cycle oil or vacuum gas oil. Further preferably, the proportions of process residues and lighter components in the low-sulfur marine diesel add up to 100%.

For the inventive improvement in the cold properties, preferably 10 to 20 000 ppm by weight, more preferably 50 to 10 000 ppm by weight and particularly 100 to 5000 ppm by weight, for example 10 to 10 000 ppm by weight, 10 to 5000 ppm by weight or else 100 to 10 000 ppm by weight, of the mixture of A) and B) is added to the low-sulfur marine diesel. Low-sulfur marine diesels treated in accordance with the invention accordingly contain 10 to 20 000 ppm by weight, more preferably 50 to 10 000 ppm by weight and particularly 100 to 5000 ppm, for example 10 to 10 000 ppm by weight, 10 to 5000 ppm by weight or else 100 to 10 000 ppm by weight, of the mixture of A) and B).

The additives, and also the low-sulfur marine diesels comprising them, may also comprise further additives, for example further paraffin inhibitors, corrosion inhibitors, antioxidants, defoamers, combustion improvers and/or lubricity improvers.

Preferred further paraffin inhibitors are ethylene copolymers which differ from (A) in at least one property, for example comonomer content, molecular weight and/or degree of branching, polyoxyalkylene compounds, alkyl phenol resins and/or nitrogen-containing paraffin dispersants (WASAs). In a preferred embodiment, they contain, based on the comb polymer (B), less than 50% by weight of WASAs, more preferably 0.01% to 20% by weight and especially 0.1% to 10% by weight, for example 0.2% to 1%, of WASAs. In a specific embodiment, they do not contain any WASA.

EXAMPLES

To assess paraffin dispersion in low-sulfur marine diesel, the components characterized in table 1 were mixed to give the marine diesels listed in table 2. The content of n-paraffins having 25 to 80 carbon atoms is determined by means of gas chromatography (GC) or high-temperature GC, and the sulfur content by means of wavelength-dispersive x-ray fluorescence analysis according to ISO 14596.

TABLE 1

Characterization of the components used for the production of low-sulfur marine diesel

| | Kerosene | Diesel | Gas oil | UCO (I) | UCO (II) |
|---|---|---|---|---|---|
| Distillation [° C.] | | | | | |
| Initial boiling point | 189 | 164 | 196 | 284 | 266 |
| 50% | 207 | 261 | 337 | 455 | 437 |
| 95% | 251 | 348 | 389 | 543 | 510 |
| Final boiling point | 263 | 358 | 396 | 570 | 530 |
| Cloud point [° C.] | <−40 | −6.8 | 14.1 | 33 | 13.9 |
| Pour point [° C.] | <−50 | −21 | 12 | 27 | 12 |
| Viscosity @ 40° C. [$mm^2/s$] | 2.0 | 3.2 | 9.8 | 23.4 | 21.2 |
| S content [ppm] | <2 | 5 | 8 | 92 | 148 |
| Density @ 15° C. [$g/cm^3$] | 0.815 | 0.8385 | 0.848 | 0.856 | 0.843 |
| n-Paraffins $C_{25}$-$C_{80}$ [%] | <0.1 | 0.6 | 1.9 | 8.0 | 13.1 |

TABLE 2

Characterization of the low-sulfur marine diesels produced from the components from table 1

| Component | | Method | Test oil 1 | Test oil 2 | Test oil 3 |
|---|---|---|---|---|---|
| Kerosene | [%] | | 12 | — | — |
| Diesel | [%] | | 27 | — | — |
| Gas oil | [%] | | — | 65 | 74 |
| UCO (I) | [%] | | 61 | — | — |
| UCO (II) | [%] | | — | 35 | 26 |
| Density @ 20° C. | [$g/cm^3$] | ASTM D-4052 | 0.858 | 0.849 | 0.845 |
| Viscosity @ 40° C. | [cSt] | ISO 3014 | 10.5 | 8.9 | 8.4 |
| Cloud point | [° C.] | ISO 3015 | 23.9 | 15.6 | 13.9 |
| Pour point | [° C.] | ASTM D-97 | 21 | 12 | 12 |
| S content | [ppm] | ISO 14596 | 58 | 62 | 45 |

Additives Used

Ethylene copolymers A) used are ethylene copolymers prepared by means of high-pressure bulk polymerization, having the properties listed in table 3. The comonomer content is determined by means of 1H NMR spectroscopy; as a measure of the molecular weight, the viscosity of the solvent-free polymer is determined at 140° C. The molecular weights are determined by means of GPC in THF against poly(styrene) standards. The polymers are used in the form of 65% by weight concentrates or, in the case of A2, as a 35% concentrate in relatively high-boiling organic solvent.

TABLE 3

Ethylene copolymers used (A)

| Polymer | Comonomer content | $V_{140}$ [mPas] | Mn [g/mol] | Mw [g/mol] |
|---|---|---|---|---|
| A1 | 13.3 mol % VAc | 125 | 3430 | 8130 |
| A2 | 11.2 mol % VAc | n.d. | 12 800 | 237 000 |
| A3 | 11.2 mol % VAc | 280 | 4600 | 12 300 |
| A4 | 16.6 mol % VAc | 50 | 2100 | 3300 |
| A5 | 14.0 mol % VAc<br>1.6 mol % VeoVa | 115 | 3300 | 8100 |

TABLE 3-continued

Ethylene copolymers used (A)

| Polymer | Comonomer content | $V_{140}$ [mPas] | Mn [g/mol] | Mw [g/mol] |
|---|---|---|---|---|
| A6 | 14.0 mol % VAc<br>2.8 propene $CH_3$ per 100 aliph. $CH_2$ groups | 170 | 3900 | 9000 |

VAc = vinyl acetate;
VeoVa ® = vinyl neononanoate;
n.d. = not determined

Comb polymers used were polymers prepared by known processes. The essentially alternating copolymers B1 to B3 and B8 to B10 formed from 50 mol % of maleic anhydride (MA) and 50 mol % of linear α-olefin are prepared in a free-radically initiated solution polymerization in organic solvent and then esterified with 2 mol of the alcohol mixture specified in table 4. The polyalkyl acrylates B4, B5 and B11 and copolymer B6 were prepared in a free-radically initiated solution polymerization. The olefin copolymer B7 was prepared in an anionic polymerization. The composition of the alcohols and olefins relates to the mol % of the components in the respective mixture. The comb polymers are used in the form of 50% concentrates in relatively high-boiling aromatic solvent.

TABLE 4

A
Comb polymers used (B)

| | |
|---|---|
| B1: | Poly(MA-co-$C_{18}$-α-olefin), esterified with 2 mol of an alcohol mixture of chain length distribution 80% $C_{14}$—OH, 1% $C_{18}$—OH, 13% $C_{20}$—OH, and 6% $C_{22}$—OH per mole of anhydride group. Sum S = 15.5 |
| B2: | Poly(MA-co-$C_{18}$-αOlefin), esterified with 2 mol of an alcohol mixture of 43% $C_{18}$—OH, 12% $C_{20}$—OH and 45% $C_{22}$—OH per mole of anhydride group, sum S = 19.5 |
| B3: | Poly(MA-co-$C_{18}$-α-olefin), esterified with 2 mol of an alcohol mixture of 5% $C_{18}$—OH, 62% $C_{20}$—OH, 29% $C_{22}$—OH and 4% $C_{24}$—OH OH per mole of anhydride group. Sum S = 19.1 |
| B4: | Poly(alkyl acrylate) formed from 32 mol % of tetradecyl acrylate, 20 mol % of hexadecyl acrylate, 2 mol % of octadecyl acrylate, 26 mol % of eicosyl acrylate, 15 mol % of docosyl acrylate and 5 mol % of tetracosyl acrylate. Sum S = 17.7 |
| B5: | Poly(alkyl acrylate) formed from 15 mol % of dodecyl acrylate, 45 mol % of tetradecyl acrylate, 20 mol % of hexadecyl acrylate, 2 mol % of octadecyl acrylate, 12 mol % of eicosyl acrylate, 6 mol % of docosyl acrylate. Sum S = 15.4 |
| B6: | Copolymer formed from approximately equal molar proportions of a fumaric diester which has been prepared by esterification of fumaric acid with an alcohol mixture of 60 mol % of $C_{14}$—OH, 29 mol % of $C_{16}$—OH, 1 mol % of $C_{18}$—OH, 7 mol % of $C_{20}$—OH and 3 mol % of $C_{22}$—OH, and vinyl acetate. Sum S = 15.3 |
| B7: | Copolymer formed from 30.2 mol % of hexadecene, 30.0 mol % of octadecene, 19.0 mol % of eicosene, 13.5 mol % of docosene, 6.5 mol % of tetracosene and 0.8 mol % of hexacosene. Sum S = 16.8 |
| B8 (comp.): | Poly(MA-co-$C_{16/18}$-olefin) having equal proportions of $C_{16}$ and $C_{18}$ olefin, esterified with 2 mol of an alcohol mixture of 10% $C_{12}$—OH, 32% $C_{14}$—OH and 58% $C_{16}$—OH per mole of anhydride groups. Sum S = 14.9 |
| B9 (comp.): | Poly(MA-co-$C_{18}$-α-olefin), esterified with 2 mol of an alcohol mixture of chain length distribution 15% $C_{10}$—OH, 46% $C_{12}$—OH and 39% $C_{14}$—OH per mole of anhydride groups. Sum S = 12.6 |
| B10 (comp.): | Poly(MA-co-$C_{20/24}$-olefin) with 3% $C_{18}$—, 44% $C_{20}$—, 35% $C_{22}$— and 18% $C_{24}$-α-olefin, esterified with 2 mol of an alcohol mixture of 5% $C_{18}$—OH, 62% $C_{20}$—OH, 29% $C_{22}$—OH and 4% $C_{24}$—OH per mole of anhydride groups. Sum S = 20.2 |
| B11 (comp.): | Poly(alkyl acrylate) formed from 7% decyl acrylate, 74% dodecyl acrylate and 19% tetradecyl acrylate. Sum S = 11.5 |

TABLE 4-continued

| B<br>Alkyl chain distribution in the side chains of the comb polymers (B), mol % | | | | | | | | |
|---|---|---|---|---|---|---|---|---|
| | $C_{10}$ | $C_{12}$ | $C_{14}$ | $C_{16}$ | $C_{18}$ | $C_{20}$ | $C_{22}$ | $C_{24}$ |
| B1 | | | 53.3 | 33.3 | 0.7 | 8.7 | 4.0 | |
| B2 | | | | 33.3 | 28.7 | | 8.0 | 30.0 |
| B3 | | | | 33.3 | 3.3 | 41.3 | 19.3 | 2.7 |
| B4 | | | 32.0 | 20.0 | 2.0 | 26.0 | 15.0 | 5.0 |
| B5 | | 15.0 | 45.0 | 20.0 | 2.0 | 12.0 | 6.0 | |
| B6 | | | 60.0 | 29.0 | 1.0 | 7.0 | 3.0 | |
| B7 | | | 30.2 | 30.0 | 19.0 | 13.5 | 6.5 | 0.8 |
| B8 (comp.) | | 3.3 | 18.7 | 78.0 | | | | |
| B9 (comp.) | 10.0 | 30.7 | 26.0 | 33.3 | | | | |
| B10 (comp.) | | | | 1.0 | 18.0 | 53.0 | 25.3 | 2.7 |
| B11 (comp.) | 7.0 | 74.0 | 19.0 | | | | | |

Paraffin Dispersion

To test the paraffin dispersion, 100 mL of the test oil are heated to 50° C., admixed with the amount of the additive concentrates specified in table 5 (the dosage rates are based on the amount of solvent-free polymer added), and agitated vigorously for 20 seconds. After determining the pour point [Pour point (before)], the oil is heated once again to 50° C. Subsequently, the oil is stored in a 100 mL upright cylinder for 72 hours, at the following temperatures:

test oil 1 at 19° C. (5° C. below the cloud point).
test oil 2 at 6° C. (10° C. below the cloud point)
test oil 3 at 9° C. (5° C. below the cloud point)
test oil 4 at 12° C. (9° C. below the cloud point)

After the storage test has ended, the upper and lower 50% by volume are assessed visually for presence of turbidity. The quantification of the amount of sediment is based on the total test volume. Subsequently, the upper 50% by volume are cautiously sucked away from the top and the pour point of the upper and lower phases is determined according to ASTM D97 [Pour point (after)], and cloud point according to ISO 3015. A turbid or at least cloudy upper phase and small differences in pour point and/or cloud point in the upper and lower phases show good dispersion. A small amount of sediment indicates weak dispersion and a compact, paraffin-rich sediment.

TABLE 5

| Paraffin dispersion in test oil 1 (storage temperature 19° C.) | | | | | | | | | | |
|---|---|---|---|---|---|---|---|---|---|---|
| | Additive (dosage rate) | | Pour point (before) | Visual assessment | | Pour point (after) [° C.] | | Cloud point [° C.] | | |
| Example | A [ppm] | B [ppm] | [° C.] | upper | lower | upper | lower | upper | lower | ΔCP |
| 1 | A1 (500) | B1 (125) | −6 | homogeneously turbid | homogeneously turbid | −3 | −6 | 21.0 | 23.5 | 2.5 |
| 2 | A1 (625) | B1 (150) | −9 | homogeneously turbid | homogeneously turbid | −6 | −9 | 21.8 | 24.0 | 2.2 |
| 3 | A1 (500) | B2 (125) | 6 | cloudy | homogeneously turbid | 3 | 6 | 17.9 | 21.2 | 3.3 |
| 4 | A1 (625) | B2 (150) | 3 | homogeneously turbid | homogeneously turbid | 3 | 6 | 18.1 | 21.1 | 3.0 |
| 5 | A1 (500) | B3 (125) | 6 | homogeneously turbid | homogeneously turbid | 3 | 6 | 20.0 | 23.2 | 3.2 |
| 6 | A1 (625) | B3 (150) | 3 | homogeneously turbid | homogeneously turbid | −3 | 0 | 20.2 | 23.1 | 2.9 |
| 7 | A1 (500) | B4 (125) | 6 | cloudy | homogeneously turbid | 3 | 6 | 20.7 | 24.3 | 3.6 |
| 8 | A1 (625) | B4 (150) | 0 | homogeneously turbid | homogeneously turbid | −3 | 3 | 20.4 | 23.6 | 3.2 |
| 9 | A1 (625) | B5 (150) | −6 | homogeneously turbid | homogeneously turbid | 3 | 6 | 20.2 | 23.6 | 3.4 |
| 10 | A1 (625) | B6 (150) | 3 | slightly turbid | homogeneously turbid | 0 | 6 | 20.0 | 23.8 | 3.8 |
| 11 | A1 (625) | B7 (150) | 6 | cloudy | homogeneously turbid | 3 | 9 | 19.9 | 23.5 | 3.6 |
| 12 | A6 (625) | B1 (150) | −6 | slightly turbid | homogeneously turbid | −6 | −3 | 20.8 | 24.6 | 3.8 |
| 13 | A2 (500) | B1 (125) | 9 | cloudy | homogeneously turbid | 6 | 12 | 19.1 | 23.8 | 4.7 |
| 14 | A2 (625) | B1 (150) | 6 | cloudy | homogeneously turbid | 6 | 9 | 19.6 | 23.5 | 3.9 |
| 15 | A3 (500) | B1 (125) | 6 | cloudy | homogeneously turbid | 3 | 6 | 18.0 | 22.9 | 4.9 |
| 16 | A3 (625) | B1 (150) | −3 | slightly turbid | homogeneously turbid | −6 | 0 | 18.4 | 22.7 | 4.3 |

TABLE 5-continued

| Paraffin dispersion in test oil 1 (storage temperature 19° C.) | | | | | | | | | | |
|---|---|---|---|---|---|---|---|---|---|---|
| | Additive (dosage rate) | | Pour point (before) | Visual assessment | | Pour point (after) [° C.] | | Cloud point [° C.] | | |
| Example | A [ppm] | B [ppm] | [° C.] | upper | lower | upper | lower | upper | lower | ΔCP |
| 17 | A4 (625) | B1 (150) | 3 | cloudy | homogeneously turbid | 0 | 6 | 19.0 | 23.1 | 4.1 |
| 18 | A4 (625) | B2 (150) | 6 | cloudy | homogeneously turbid | 3 | 9 | 18.3 | 23.5 | 5.2 |
| 19 (comp.) | A1 (500) | B8 (125) | −3 | clear | 10% sediment | −6 | +3 | 18.1 | 27.8 | 9.7 |
| 20 (comp.) | A1 (625) | B8 (150) | −3 | clear | 20% sediment | −9 | −6 | 17.5 | 26.0 | 8.5 |
| 21 (comp.) | A1 (500) | B9 (125) | 15 | clear | 20% sediment | 6 | 18 | 17.9 | 25.0 | 7.1 |
| 22 (comp.) | A1 (625) | B9 (150) | 12 | clear | 40% sediment | 15 | 12 | 17.5 | 25.4 | 7.9 |
| 23 (comp.) | A1 (625) | B10 (150) | 9 | clear | 20% sediment | 12 | 6 | 17.8 | 24.4 | 6.6 |
| 24 (comp.) | A1 (625) | B11 (150) | 12 | clear | 60% sediment | 15 | 18 | 18.0 | 27.1 | 9.1 |
| 25 (comp.) | A1 (660) | — | 15 | clear | 50% sediment | 6 | 18 | 17.5 | 25.4 | 7.9 |
| 26 (comp.) | A1 (825) | — | 12 | clear | 50% sediment | 6 | 15 | 17.8 | 24.4 | 6.6 |
| 27 (comp) | — | B1 (150) | 18 | homogeneous; not free-flowing | | not applicable | | | | |
| 28 (comp) | — | B2 (150) | 18 | homogeneous; not free-flowing | | not applicable | | | | |
| 29 (comp) | — | B3 (150) | 18 | homogeneous; not free-flowing | | not applicable | | | | |
| 30 (comp) | — | — | 21 | homogeneous; not free-flowing | | not applicable | | | | |

(comp.) = comparative measurement, non-inventive

TABLE 6

| Paraffin dispersion in test oil 2 (storage temperature 6° C.) | | | | | | | | | | |
|---|---|---|---|---|---|---|---|---|---|---|
| | Additive (dosage rate) | | Pour point (before) | Visual assessment | | Pour point (after) [° C.] | | Cloud point [° C.] | | |
| Example | A [ppm] | B [ppm] | [° C.] | upper | lower | upper | lower | upper | lower | ΔCP |
| 31 | A5 (150) | B1 (100) | −6 | homogeneously turbid | homogeneously turbid | −6 | −6 | 14.2 | 15.7 | 1.5 |
| 32 | A5 (150) | B3 (100) | −6 | homogeneously turbid | homogeneously turbid | −6 | −3 | 14 | 16 | 2.0 |
| 33 | A5 (150) | B5 (100) | −3 | homogeneously turbid | homogeneously turbid | −6 | 0 | 14.2 | 15.6 | 1.4 |
| 34 | A5 (150) | B6 (100) | 0 | cloudy | homogeneously turbid | −3 | 0 | 13.8 | 16 | 2.2 |
| 35 | A2 (150) | B1 (100) | −6 | cloudy | homogeneously turbid | −6 | −3 | 14.2 | 16.1 | 1.9 |
| 36 | A2 (150) | B2 (100) | −3 | cloudy | homogeneously turbid | −6 | 0 | 13.9 | 15.9 | 2.0 |
| 37 | A5 (150) | B8 (100) | 0 | clear | 30% sediment | −9 | 3 | 5.7 | 16.7 | 11.0 |
| 38 | A2 (150) | B9 (100) | 3 | clear | 25% sediment | −6 | 6 | 5.8 | 17 | 11.2 |
| 39 (comp.) | A5 (150) | — | 0 | clear | 20% sediment | −9 | 9 | 6.0 | 17.4 | 11.4 |
| 40 (comp.) | A2 (150) | — | 3 | clear | 20% sediment | −9 | 9 | 5.9 | 17.8 | 11.9 |
| 41 (comp.) | — | B1 (100) | 9 | homogeneous; not free-flowing | | not applicable | | | | |
| 42 (comp.) | — | B3 (100) | 9 | homogeneous; not free-flowing | | not applicable | | | | |
| 43 (comp.) | — | — | 12 | homogeneous; not free-flowing | | not applicable | | | | |

(comp.) = comparative measurement, non-inventive

TABLE 7

| Paraffin dispersion in test oil 3 (storage temperature 9° C. | | | | | | | | | | |
|---|---|---|---|---|---|---|---|---|---|---|
| | Additive (dosage rate) | | Pour point (before) | Visual assessment | | Pour point (after) [° C.] | | Cloud point [° C.] | | |
| Example | A [ppm] | B [ppm] | [° C.] | upper | lower | upper | lower | lower | upper | ΔCP |
| 44 | A6 (150) | B1 (40) | −6 | homogeneously turbid | homogeneously turbid | −6 | −6 | 12.1 | 13.6 | 1.5 |
| 45 | A6 (150) | B2 (40) | −3 | homogeneously turbid | homogeneously turbid | −6 | −3 | 11.9 | 13.7 | 1.8 |
| 46 | A6 (150) | B4 (40) | −3 | homogeneously turbid | homogeneously turbid | −3 | 0 | 11.7 | 13.9 | 2.2 |

TABLE 7-continued

| Paraffin dispersion in test oil 3 (storage temperature 9° C. | | | | | | | | | | |
|---|---|---|---|---|---|---|---|---|---|---|
| | Additive (dosage rate) | | Pour point (before) | Visual assessment | | Pour point (after) [° C.] | | Cloud point [° C.] | | |
| Example | A [ppm] | B [ppm] | [° C.] | upper | lower | upper | lower | lower | upper | ΔCP |
| 47 | A6 (150) | B6 (40) | 0 | cloudy | homogeneously turbid | −3 | 0 | 11.5 | 14.5 | 3.0 |
| 48 | A6 (150) | B7 (40) | −3 | cloudy | homogeneously turbid | −6 | −3 | 11.4 | 14.3 | 2.9 |
| 49 (comp.) | A6 (150) | B10 (40) | 3 | clear | 35% Sediment | −3 | 9 | 8.6 | 16.3 | 7.7 |
| 50 (comp.) | A6 (150) | B11 (40) | 3 | clear | 30% sediment | −3 | 9 | 8.9 | 16.7 | 7.8 |
| 51 (comp.) | A6 (150) | — | 6 | clear | 20% Sediment | −6 | 12 | 8.6 | 16.1 | 7.5 |
| 52 (comp.) | — | B1 (40) | 12 | homogeneous; not free-flowing | | not applicable | | | | |
| 53 (comp.) | — | B6 (40) | 12 | homogeneous; not free-flowing | | not applicable | | | | |
| 54 (comp.) | — | — | 12 | homogeneous; not free-flowing | | not applicable | | | | |

(comp.) = comparative measurement, non-inventive

Testing of the Filterability of Low-Sulfur Marine Diesel

To test the influence of additives comprising ethylene copolymer (A) and comb polymer (B) on the filterability of low-sulfur marine diesel, 100 mL of the additized oil were stored in accordance with the conditions described above for the paraffin dispersion (16 h, 5° C. below cloud point) stored. Subsequently, the oil, at the storage temperature, without prior heating, was sucked through a pipette out of the bottom of the measuring cylinder (100 mL) through a paper filter (Ø 4 cm, pore size ≈0.6 μm) at a constant absolute vacuum of 125 mbar. At intervals of 10 seconds, the time that was required for the filtration of the entire sample volume was determined, or, for samples that are difficult to filter, the volume filtered within 5 minutes. The dispersion was assessed here only qualitatively and was assessed as very good (++) when the upper phase was homogeneously turbid, as good (+), when the upper phase was cloudy and the lower phase was without separated sediment, or as poor (−) when the upper phase was clear and a sediment was visible.

TABLE 8

| Filterability of test oil 1 at 19° C. (after storage at 19° C.) | | | | | |
|---|---|---|---|---|---|
| | Additive (dosage rate) | | | Filtration | |
| Example | A [ppm] | B [ppm] | Dispersion | t [sec.] | Vol. [mL] |
| 55 | A1 (500) | B1 (125) | + | 150 | 100 |
| 56 | A1 (625) | B1 (150) | ++ | 120 | 100 |
| 57 | A1 (625) | B2 (150) | ++ | 130 | 100 |
| 58 | A1 (500) | B3 (125) | + | 180 | 100 |
| 59 | A1 (625) | B3 (150) | ++ | 150 | 100 |
| 60 | A1 (625) | B4 (150) | ++ | 200 | 100 |
| 61 | A1 (625) | B5 (150) | ++ | 130 | 100 |
| 62 | A3 (625) | B1 (150) | ++ | 200 | 100 |
| 63 | A4 (625) | B1 (150) | ++ | 220 | 100 |
| 64 | A6 (625) | B1 (150) | + | 240 | 100 |
| 65 (comp.) | A1 (625) | B8 (150) | — | 300 | 50 |
| 66 (comp.) | A1 (625) | B9 (150) | — | 300 | 28 |
| 67 (comp.) | A1 (625) | B10 (150) | — | 300 | 70 |
| 68 (comp.) | A1 (625) | — | — | 300 | 35 |
| 69 (comp.) | — | B1 (150) | solid | not free-flowing | |
| 70 (comp.) | — | B3 (150) | solid | not free-flowing | |
| 71 (comp.) | — | — | solid | not free-flowing | |

TABLE 9

| Filterability of test oil 2 at 6° C. (after storage at 6° C.) | | | | | |
|---|---|---|---|---|---|
| | Additive (dosage rate) | | | Filtration | |
| Example | A [ppm] | B [ppm] | Dispersion | t [sec.] | Vol [mL] |
| 72 | A5 | B1 | ++ | 110 | 100 |
| 73 | A5 | B2 | ++ | 130 | 100 |
| 74 | A5 | B6 | ++ | 130 | 100 |
| 75 | A5 | B7 | ++ | 120 | 100 |
| 76 (comp.) | A5 | B8 | — | 300 | 70 |
| 77 (comp.) | A5 | B11 | — | 300 | 90 |
| 78 (comp. | A5 | — | — | 300 | 35 |
| 79 (comp.) | — | B2 | solid | not free-flowing | |
| 80 (comp.) | — | B6 | solid | not free-flowing | |
| 81 (comp.) | — | — | solid | not free-flowing | |

In a further test series, the influence of the mixing ratio of components A and B on lowering of pour point, paraffin dispersion and filterability below the cloud point for a low-sulfur marine diesel was examined. For this purpose, a low-sulfur marine diesel (test oil 4) was used, which consisted of the UCOs III and IV and gas oil (II) with the characteristics reproduced in table 10.

TABLE 10

| Characterization of test oil 4 and the underlying components | | | | | |
|---|---|---|---|---|---|
| | Method | UCO (III) | UCO (IV) | Gas oil (II) | Test oil 4 |
| Density @ 20° C. [g/cm$^3$] | ASTM D-4052 | 0.946 | 0.937 | 0.899 | 0.929 |
| Viscosity @ 40° C. [cSt] | ISO 3014 | 19 | 6.4 | 2.2 | 10.6 |
| Cloud point [° C.] | ISO 3015 | 29.5 | 11.0 | −4.8 | 20.8 |
| Pour point [° C.] | ASTM D-97 | 27 | 9 | −9 | 21 |
| S content [ppm] | ISO 14596 | 154 | 72 | 30 | 93 |
| Proportion in test oil 4 [% by wt.] | — | 39.6 | 29.6 | 30.8 | 100 |

TABLE 11

Improvement in flowability, dispersion and filterability of test oil 4 at 12° C. (after storage at 12° C.)

| Example | Additive (dosage rate) A1 [ppm] | B1 [ppm] | Pour point [° C.] | Dispersion | Filtration t [sec.] | Vol. [mL] |
|---|---|---|---|---|---|---|
| 82 (comp.) | 0 | 300 | 15 | solid | not free-flowing | |
| 83 | 30 | 270 | 6 | + | 210 | 100 |
| 84 | 50 | 250 | 3 | ++ | 190 | 100 |
| 85 | 75 | 225 | 0 | ++ | 160 | 100 |
| 86 | 150 | 150 | 0 | ++ | 140 | 100 |
| 87 | 200 | 100 | −3 | ++ | 130 | 100 |
| 88 | 225 | 75 | −3 | ++ | 120 | 100 |
| 89 | 250 | 50 | 3 | + | 160 | 100 |
| 90 | 270 | 30 | 6 | + | 230 | 100 |
| 91 (comp.) | 300 | 0 | 9 | — | 300 | 40 |
| 92 (comp.) | 0 | 0 | 21 | solid | not free-flowing | |

The experiments show that additives comprising ethylene copolymers (A) and comb polymers (B) lead to good dispersion in wide mixing ratios, and the low-sulfur marine diesels additized therewith are filterable without difficulty. Additization with noninventive additives, by contrast, leads to marked sedimentation of the paraffins and to rapid filter blockage. While ethylene copolymers (A) on their own, and also combinations with noninventive comb polymers, lead to lowering of the pour point, only in combination with comb polymers (B) of the invention are good dispersion and filterability achieved. Comb polymers (B) on their own bring about only marginal lowering of the pour point, and so the samples solidify at storage temperatures below the pour point. In oils additized in this way, there is no sedimentation of paraffins, but they are not pumpable either. For this reason, separation and separate examination of upper and lower phase cannot be conducted in a comparable manner.

In further comparative experiments, a dark-colored bunker oil comprising residues from mineral oil distillation and having 2.9% by weight of sulfur was examined with regard to the influence of the additives of the invention on lowering of the pour point and on the influencing of paraffin dispersion and filterability by the test methods described above for low-sulfur marine diesel. Because of the low transparency of the bunker oil, the paraffin dispersion was assessed by determining the wax appearance temperature (by means of differential scanning calorimetry, DSC).

Further characteristics of the bunker oil used were a density (at 20° C.) of 0.995 g/cm$^3$, a viscosity (at 40° C.) of 280 cSt, a pour point of 33° C. and a wax appearance temperature (corresponding to the cloud point, which cannot be determined in oils comprising residues) of 47° C.

TABLE 12

Improvement of flowability, dispersion and filterability of a bunker oil with 2.9% sulfur at 30° C. (after storage at 30° C.)

| Example | Additive (dosage rate) A1 [ppm] | B1 [ppm] | Pour point [° C.] | Dispersion WAT (upper) | WAT (lower) | Filtration t [sec.] | Vol. [mL] |
|---|---|---|---|---|---|---|---|
| 93 (comp.) | 500 | 125 | 30 | 47° C. | 47° C. | 300 | <10 |
| 94 (comp.) | 1000 | 250 | 27 | 47° C. | 47° C. | 300 | <10 |

TABLE 12-continued

Improvement of flowability, dispersion and filterability of a bunker oil with 2.9% sulfur at 30° C. (after storage at 30° C.)

| Example | Additive (dosage rate) A1 [ppm] | B1 [ppm] | Pour point [° C.] | Dispersion WAT (upper) | WAT (lower) | Filtration t [sec.] | Vol. [mL] |
|---|---|---|---|---|---|---|---|
| 95 (comp.) | 0 | 0 | 33 | 47° C. | 47° C. | 300 | <10 |

Comparative experiments 93 to 95 show that the phenomenon of paraffin sedimentation which is observed in low-sulfur marine diesel does not occur in conventional sulfur-rich bunker oil, and that filtration through fine filters is not possible.

The invention claimed is:

1. A fuel oil composition comprising a low-sulfur marine diesel having a sulfur content of less than 1% by weight and (A) at least one ethylene copolymer containing, as well as ethylene, 8.0 to 17 mol % of one or more vinyl and/or (meth)acrylic esters, and (B) at least one comb polymer (B) comprising structural units B1 which derive from $C_{10}$-$C_{28}$-alkyl esters of unsaturated mono- and dicarboxylic acids, $C_{10}$-$C_{28}$-alkyl vinyl esters, $C_{10}$-$C_{28}$-alkyl vinyl ethers, $C_{10}$-$C_{28}$-alkyl allyl ethers and/or linear $C_{12}$-$C_{30}$-α-olefins, and wherein at least 20 mol % of the alkyl radicals bonded to the repeat structural units (B1) have 12 to 16 carbon atoms and at least 5 mol % of the alkyl radicals have 18 or more carbon atoms, in which the untreated low-sulfur marine diesel has a pour point of +6° C. or higher.

2. The fuel oil composition as claimed in claim 1, in which the low-sulfur marine diesel has a viscosity of not more than 200 mm$^2$/s at 40° C.

3. The fuel oil composition as claimed in claim 1, in which the low-sulfur marine diesel has a viscosity of not more than 11 mm$^2$/s at 40° C.

4. The fuel oil composition as claimed in claim 1, wherein the low-sulfur marine diesel comprises a residue from the further processing of a mineral oil distillate.

5. The fuel oil composition as claimed in claim 1, wherein the low-sulfur marine diesel has a sulfur content of 0.1% by weight or lower.

6. The fuel oil composition as claimed in claim 4, wherein the residue from the further processing of a mineral oil distillate which is used for production of the low-sulfur marine diesel contains at least 3% by weight of paraffins having more than 24 carbon atoms.

7. The fuel oil composition as claimed in claim 4, wherein the residue from the further processing of a mineral oil distillate which is used for production of the low-sulfur marine diesel has a pour point of 9° C. or higher.

8. The fuel oil composition as claimed in claim 1, wherein the ethylene copolymer (A) contains, as well as ethylene and 8.0 to 17 mol % of one or more vinyl and/or (meth)acrylic esters, also 0.1 to 5 mol % of one or more olefins having 3-8 carbon atoms.

9. The fuel oil composition as claimed in claim 8, in which the olefin is propene.

10. The fuel oil composition as claimed in claim 1, wherein the ethylene copolymer (A) contains one or more vinyl esters derived from carboxylic acids having 3 to 12 carbon atoms.

11. The fuel oil composition as claimed in claim 10, in which the vinyl ester is vinyl acetate.

12. The fuel oil composition as claimed in claim 1, wherein the number-average molecular weight $M_n$ of the ethylene copolymer (A) is between 1000 and 7000 g/mol.

13. The fuel oil composition as claimed in claim 1, wherein the comb polymer (B) includes at least 40 mol % of repeat structural units (B1) that bear $C_{10}$-$C_{28}$-alkyl radicals.

14. The fuel oil composition as claimed in claim 1, wherein the sum S $$S = \frac{\left( m_1 \cdot p_1 \cdot \sum_i w_{1i} \cdot n_{1i} + m_2 \cdot p_2 \cdot \sum_j w_{2j} \cdot n_{2j} + \ldots + m_g \cdot p_g \sum_p w_{gp} \cdot n_{gp} \right)}{(m_1 \cdot p_1 + m_2 \cdot p_2 + \ldots + m_g \cdot p_g)}$$

of the molar averages of the carbon chain length distributions in the alkyl radicals of the structural units (B1) is 15.0 to 20.0, in which $m_1, m_2, \ldots m_g$ are the mole fractions of the abovementioned monomers in the polymer (B), where the sum of the mole fractions $m_1$ to $m_g$=1, $p_1; p_2; \ldots p_g$ is the number of alkyl radicals per monomer unit and is an integer of 1, 2 or 3, $w_{1i}, w_{1j} \ldots w_{2i} \ldots w_{gp}$ are the proportions by weight of the individual chain lengths i, j, . . . p of the alkyl radicals of the various monomers (B) 1 to g in the polymer, and $n_{1i}, n_{1j} \ldots n_{2i}, n_{2j} \ldots n_{gp}$ are the chain lengths of the alkyl radicals i, j, . . . p of the monomers in the polymer (B) 1 to g.

15. The fuel oil composition as claimed in claim 1, wherein the carbon chain length distribution in the alkyl radicals of the structural units (B1) is implemented in one polymer.

16. The fuel oil composition as claimed in claim 1, wherein the carbon chain length distribution in the alkyl radicals of the structural units (B1) is implemented by mixing two or more polymers.

17. The fuel oil composition as claimed in claim 1, wherein the comb polymer (B) contains 1 to 60 mol % of repeat structural units (B2) other than the structural units (B1).

18. The fuel oil composition as claimed in claim 17, wherein the repeat structural units (B2) derive from unsaturated mono- and dicarboxylic acids or their to $C_9$-alkyl esters, $C_1$-$C_9$-alkyl vinyl esters, $C_1$-$C_9$-alkyl vinyl ethers, $C_1$-$C_9$-alkyl allyl ethers, linear $C_3$-$C_8$-α-olefins and/or branched $C_4$-$C_{50}$-olefins.

19. The fuel oil composition as claimed in claim 1, wherein the number-average molecular weight of the comb polymers (B) is between 1000 and 100 000 g/mol.

20. The fuel oil composition as claimed in claim 1, wherein the comb polymers (B) are selected from the group consisting of:

a) homo- and copolymers of $C_{10}$-$C_{28}$-alkyl vinyl esters, $C_{10}$-$C_{28}$-alkyl vinyl ethers and unsaturated $C_{10}$-$C_{28}$-alkyl monocarboxylates, b) copolymers, esterified with $C_{10}$-$C_{28}$-alcohols, of unsaturated dicarboxylic acids or anhydrides thereof with $C_{12}$-$C_{30}$-α-olefins, $C_{10}$-$C_{28}$-alkyl acrylates, $C_{10}$-$C_{28}$-alkyl methacrylates, $C_{10}$-$C_{28}$-alkyl vinyl esters and/or $C_{10}$-$C_{28}$-alkyl vinyl ethers, c) $C_{10}$-$C_{28}$-alkyl fumarate-$C_1$-$C_5$-alkyl vinyl ester copolymers and d) polymers of Cu-Cm-α-olefins.

21. The fuel oil composition as claimed in claim 17, wherein the monomers B1 and B2 in the comb polymer (B) add up to 100 mol %.

22. The fuel oil composition as claimed in claim 1, containing a sum total of 0.001% to 2% by weight of the additive components (A) and (B).

23. The fuel oil composition as claimed in claim 1, wherein the fuel oil composition contains, per part by weight of the ethylene copolymer A), 0.05 to 20 parts by weight of the comb polymer B).

24. The fuel oil composition as claimed in claim 1, containing, based on the total amount of A) and B), less than 10% by weight of a nitrogen compound effective as a paraffin dispersant in middle distillates.

25. The fuel oil composition as claimed in claim 1, wherein the low-sulfur marine diesel contains not more than 5% by weight of a residue from the processing of a desulfurized heavy gas oil.

26. A method of dispersing paraffins which precipitate out of low-sulfur marine diesel having a sulfur content of 1% by weight or lower on storage at temperatures below the cloud point, by adding to the low-sulfur marine diesel an ethylene copolymer (A) containing, as well as ethylene, 8.0 to 17 mol % of one or more vinyl and/or (meth)acrylic esters, and a comb polymer (B) comprising structural units B1 which derive from $C_{10}$-$C_{28}$-alkyl esters of unsaturated mono- and dicarboxylic acids, $C_{10}$-$C_{28}$-alkyl vinyl esters, $C_{10}$-$C_{28}$-alkyl vinyl ethers, $C_{10}$-$C_{28}$-alkyl allyl ethers and/or linear $C_{12}$-$C_{30}$-α-olefins, and wherein at least 20 mol % of the alkyl radicals bonded to the repeat structural units (B1) have 12 to 16 carbon atoms and at least 5 mol % of the alkyl radicals have 18 or more carbon atoms, and in which the untreated low-sulfur marine diesel has a pour point of +6° C. or higher.

27. The method as claimed in claim 25, wherein a total of between 10 and 20 000 ppm by weight of additive components (A) and (B) are added to the low-sulfur marine diesel.

28. A method of dispersing paraffins which precipitate out of a low-sulfur marine diesel having a sulfur content of 1% by weight or lower on storage below the cloud point, wherein the low-sulfur marine diesel contains an ethylene copolymer (A), by adding a comb polymer (B) comprising structural units B1 which derive from $C_{10}$-$C_{28}$-alkyl esters of unsaturated mono- and dicarboxylic acids, $C_{10}$-$C_{28}$-alkyl vinyl esters, $C_{10}$-$C_{28}$-alkyl vinyl ethers, $C_{10}$-$C_{28}$-alkyl allyl ethers and/or linear $C_{12}$-$C_{30}$-α-olefins, and wherein at least 20 mol % of the alkyl radicals bonded to the repeat structural units (B1) have 12 to 16 carbon atoms and at least 5 mol % of the alkyl radicals have 18 or more carbon atoms, in which the untreated low-sulfur marine diesel has a pour point of +6° C. or higher, and in which the ethylene copolymer (A) contains, as well as ethylene, 8.0 to 17 mol % of one or more vinyl and/or (meth)acrylic esters.

* * * * *